US006287172B1

(12) United States Patent
Kuan et al.

(10) Patent No.: US 6,287,172 B1
(45) Date of Patent: Sep. 11, 2001

(54) METHOD FOR IMPROVEMENT OF TUNGSTEN CHEMICAL-MECHANICAL POLISHING PROCESS

(75) Inventors: Tong-Hua Kuan, Hsin-Chu; Hui-Ling Wang, Taipei; Ying-Lang Wang, Lung-Ching Hsiang; Chin-Kun Lan, Taichung, all of (TW)

(73) Assignee: Taiwan Semiconductor Manufacturing Co., Ltd. (TW)

( * ) Notice: Subject to any disclaimer, the term of this patent is extended or adjusted under 35 U.S.C. 154(b) by 0 days.

(21) Appl. No.: 09/465,700

(22) Filed: Dec. 17, 1999

(51) Int. Cl.[7] ..... B24B 1/00

(52) U.S. Cl. ..... 451/41; 451/288; 451/287; 451/285

(58) Field of Search ..... 451/41, 288, 287, 451/285; 134/102.2

(56) References Cited

U.S. PATENT DOCUMENTS 4,583,325 * 4/1986 Tabuchi ..... 451/41
4,693,036 * 9/1987 Mori ..... 451/131.5
5,853,317 * 12/1998 Yamamoto ..... 451/288
5,887,605 * 3/1999 Lee et al. ..... 134/102.2
5,902,173 * 5/1999 Tanaka ..... 451/56
5,934,980 * 8/1999 Koos et al. ..... 451/41
5,985,093 * 11/1999 Chen ..... 451/41
6,093,085 * 7/2000 Yellitz et al. ..... 451/41
6,106,728 * 8/2000 Iida et al. ..... 451/287
6,165,050 * 12/2000 Ban et al. ..... 451/8

* cited by examiner

*Primary Examiner*—Joseph J. Hail, III
*Assistant Examiner*—Lee Wilson

(57) ABSTRACT

A multi-step chemical-mechanical polishing method for improving tungsten chemical-mechanical polishing (CMP) process is provided in the present invention. The method comprises following steps. First, a wafer is placed on a first pad of a CMP system, wherein a head fixes the wafer on the first pad. Then, the head is rotated and the wafer is polished on the first pad by using a tungsten slurry. Next, the wafer is transferred to place on a second pad of the CMP system, wherein the head fixes the wafer on the second pad. Following, the head is rotated and the wafer is polished on the second pad by using the tungsten slurry. Then, the wafer is cleaned on the second pad by using a de-ionic water. Next, the wafer is transferred to place on a third pad of the CMP system, wherein the head fixes the wafer on the third pad. Following, the wafer is cleaned on the third pad by using the de-ionic water. Last, the head is rotated and the wafer is polished on the third pad by using an oxide slurry, wherein a pH value of the tungsten slurry and a pH value of the oxide slurry are opposite.

6 Claims, 3 Drawing Sheets

METHOD FOR IMPROVEMENT OF TUNGSTEN CHEMICAL-MECHANICAL POLISHING PROCESS

BACKGROUND OF THE INVENTION

1. Field of the Invention

The present invention relates to chemical-mechanical polishing, and more particularly using elimination solution to improve a multi-step chemical-mechanical polishing method during the chemical-mechanical polishing is operating.

2. Description of the Prior Art

Chemical-mechanical polishing (CMP) is conventionally used in semiconductor manufacturing to achieve global planarity, usually with planarity greater than 94%. Normally the operation of the chemical-mechanical polishing combines both of chemical and mechanical effects. The chemical-mechanical polishing generally includes rotating table, where slurry and polishing pad are applied. Conventionally typical polishing slurry comprises $SiO_2$, alumna $Al_2O_3$ in an alkali solution.

There generally will be many particles existing on the surface of wafer after tungsten chemical-mechanical polishing WCMP process. All particles usually distribute onto the surface edge of wafer. Due to the inherent drawbacks of the chemical-mechanical polishing mechanism, the slurry effect is clearly observed after the chemical-mechanical polishing, causing serious alkali or acid solution effect including $SiO_2$ and $Al_2O_3$ slurry, which disadvantageously affects following manufacturing process. Normally solution effect will appear obviously if oxide wafer with oxide slurry buffing process is carried out. However, particles would not exist on tungsten wafer with oxide slurry buffing process. Due to the pH rate of tungsten slurry is about 2.3 and the pH rate of oxide slurry is about 11. Probably the neutralization of chemical reaction happens leading to the special morphologic particles existed as FIG. 1A. And FIG. 1B shows for its close-up dramatic picture.

According to the foregoing reasons, a method is exactly needed for eliminating the solution effect during the chemical-mechanical polishing in order to improve and reduce either alkali or acid solution effecting the result of polishing process.

SUMMARY OF THE INVENTION

In one embodiment, In accordance with the present invention, an improved chemical-mechanical polishing (CMP) method is provided that substantially eliminates the solution effect during the CMP process, thereby improving the alkali or acid solution of polishing process.

Therefore this method for chemical-mechanical polishing process is obviously disclosed. The method comprises following steps. First, a wafer is placed on a first pad of a CMP system, wherein a head fixes the wafer on said first pad. Then, the head is rotated and the wafer is polished on the first pad by using a tungsten slurry. Next, the wafer is transferred to place on a second pad of the CMP system, wherein the head fixes the wafer on the second pad. Following, the head is rotated and the wafer is polished on the second pad by using the tungsten slurry. Then, the wafer is cleaned on the second pad by using a de-ionic water. Next, the wafer is transferred to place on a third pad of the CMP system, wherein the head fixes the wafer on said third pad. Following, the wafer is cleaned on the third pad by using the de-ionic water. Last, the head is rotated and the wafer is polished on the third pad by using an oxide slurry, wherein a pH value of the tungsten slurry and a pH value of the oxide slurry are opposite.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

The following is a description of the present invention. The invention will firstly be described with reference to one exemplary structure. Some variations will then be described as well as advantages of the present invention. A preferred method of fabrication will then be discussed. An alternate, asymmetric embodiment will then be described along with the variations in the process flow to fabricate this embodiment.

The method of the present invention is applied to a broad range of chemical-mechanical polishing (CMP) process. The following description discusses several presently preferred embodiments of the WCMP of the present invention as implemented in CMP process, since the majority of currently available CMP process are used in silicon processing and the most commonly encountered applications of the present invention is involved about the slurry solution problem. Nevertheless, the present invention may also be advantageously employed in conventionally CMP process, and other semiconductor materials. Accordingly, application of the present invention is not intended to be limited to those devices fabricated in silicon semiconductor materials, but will include those devices fabricated in one or more of the available semiconductor materials.

Moreover, while the present invention is illustrated by a number of preferred embodiments directed to WCMP process, it is not intended that these illustrations be a limitation on the scope or applicability of the present invention. Further, while the illustrative examples use insulated WCMP process, it should be recognized that the insulated gate portions might be replaced with other chemical-mechanical polishing process. Thus, it is not intended that the semiconductor devices of the present invention be limited to the structures illustrated. These devices are included to demonstrate the utility and application of the present invention to presently preferred embodiments.

Figure 1A:
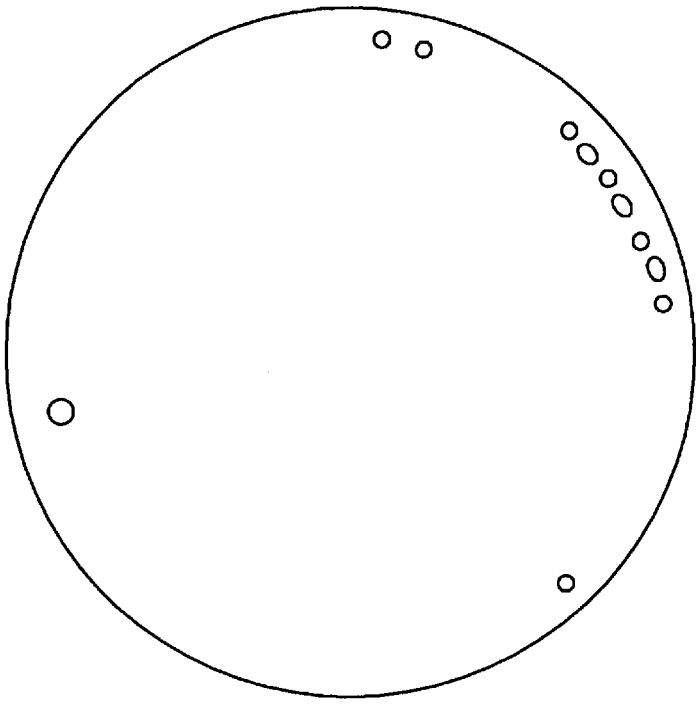
FIG. 1A shows a dramatic picture resulted from the verification in connection with the prior art.
Figure 1B:
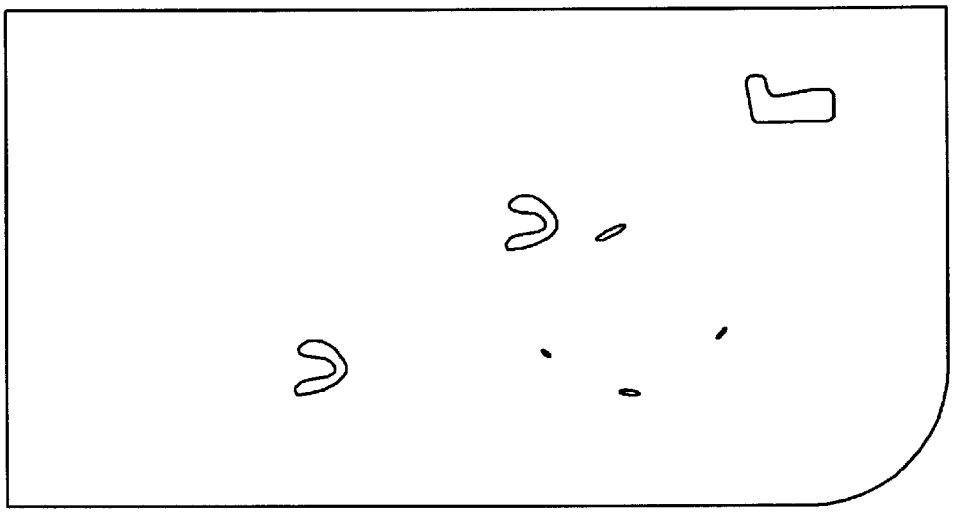
FIG. 1B shows a vector map resulted from the verification in connection in connection with the prior art.
Figure 2A:
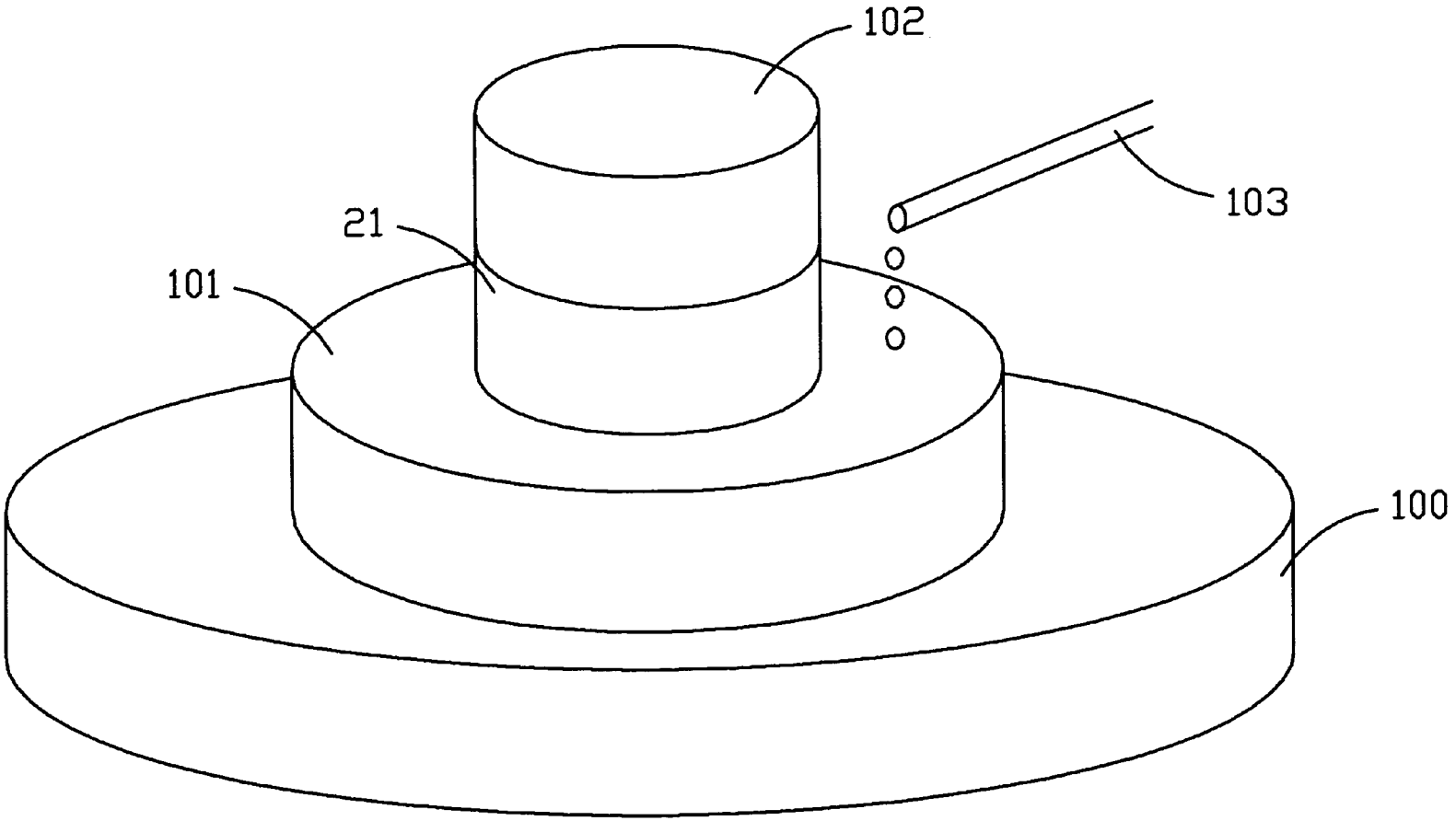
FIG. 2A shows a chemical-mechanical polishing (CMP) system illustrating one embodiment according to the present invention.

In one embodiment, as FIG. 2A a semiconductor wafer 21 is initially placed on platen 100 of a chemical-mechanical polishing system as FIG. 2, followed by polishing the wafer with pad 101, wherein head 102 rotates with respect to the platen 100. Thereafter, the wafer 21 is polished with pad 101, wherein head 102 rotates in the same platen. Then semiconductor wafer 21 is cleaned up using deionic water from slurry pine 103 in order to wash the retained alkali or acid solution on the surface of semiconductor wafer 21. The de-ionic water can be transferred from another individual pine of the CMP system. With respect to platen 100, thereby the solution effect to the surface of wafer 21 is improved.

Figure 2B:
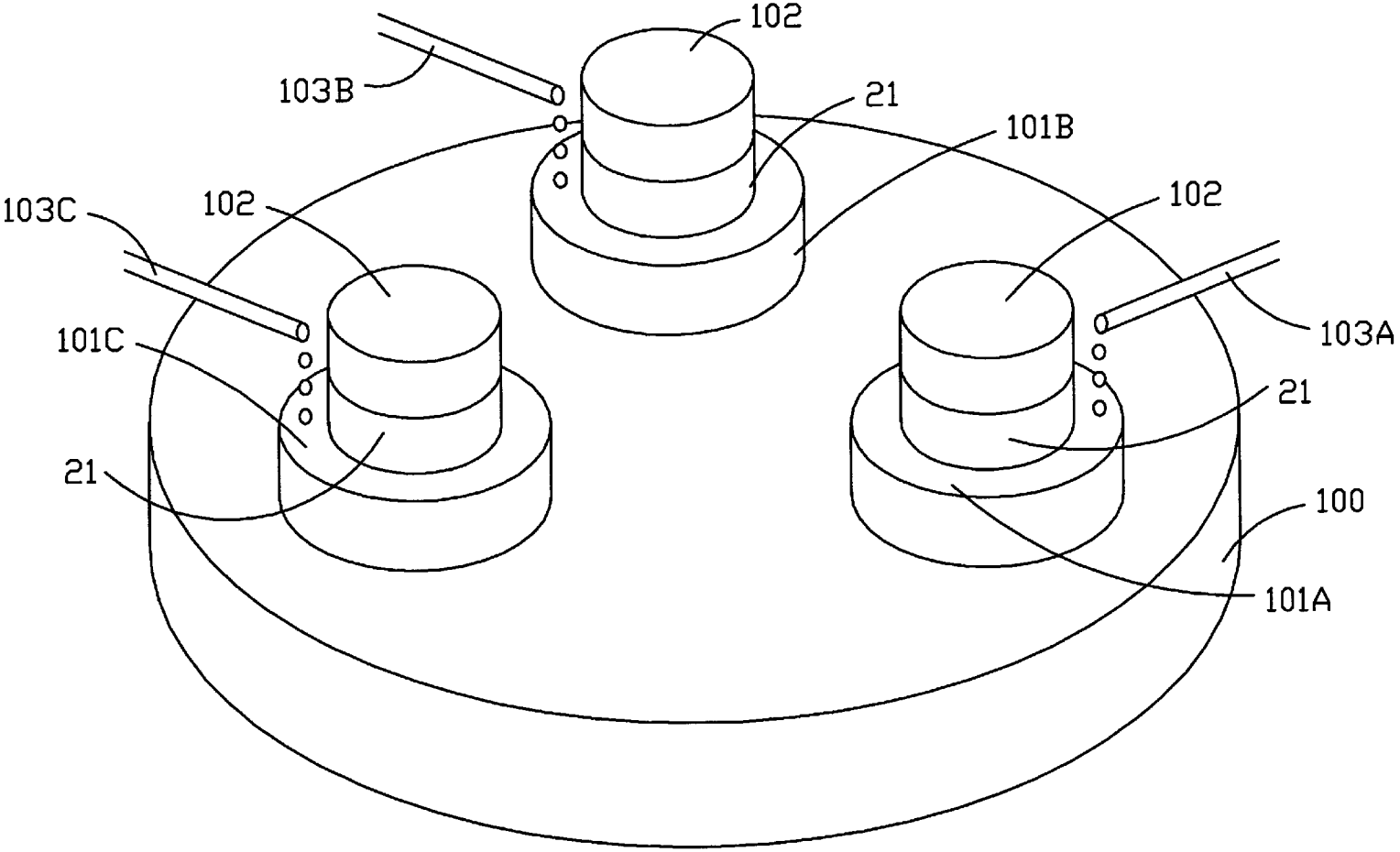
FIG. 2B schematically shows a chemical-mechanical polishing (CMP) system illustrating another embodiment according to the present invention.

In another embodiment of the present invention, as FIG. 2B a semiconductor wafer is initially placed on first pad 101A of a chemical-mechanical polishing system, followed by polishing wafer 21 in the first pad 101A with a tungsten slurry. A head 102 fixes the wafer 21 on the pad and the head is rotated in the polishing process. The wafer is then transferred and placed on a second pad 101B of the chemical-mechanical polishing system, followed by polishing wafer 21 in the second pad 101B with the tungsten slurry. Hence wafer 21 is cleaned up using the de-ionic water from slurry pine 103B after head 102 completes the rotation with respect to second pad 101B. Thereafter, again the wafer will be transferred and placed on third pad 101C of the chemical-mechanical polishing system, followed by polishing wafer 21 with the third pad 101C with an oxide slurry. Also, firstly wafer 21 is cleaned up using the de-ionic water from slurry pine 103C and then the head will accomplish rotation.

The duration of polishing the wafer in the second pad is approximately equal to duration of polishing the wafer in the third pad. Also, the duration of cleaning the wafer in the second pad is approximately equal to duration of cleaning the wafer in third pad 101C. The solution usually is used to the de-ionic water. For tungsten film with tungsten slurry is about 2 KÅ. Polishing remained tungsten film with tungsten slurry by end-point system is on first pad 101A and second pad 101B. Another for polishing oxide film with oxide slurry system is on third pad 101C. Finally for polishing oxide film, its thickness of oxide film is about 200 to 500 Å with oxide slurry system. Especially the pH value of the tungsten slurry and the oxide slurry is opposite due to the pH value of tungsten slurry is about 2.3 and oxide slurry is about 11. Therefore de-ionic water could eliminate retained tungsten slurry and make wafer clearly. Then the oxide slurry steps will consequentially follow.

The defect that is edge distribution type will not appear after the above process completed because de-ionic water could remove alkali or acid slurry. It is sufficient not only to reduce defect count until less than 50 ea level but also to reduce the failure rate less than 5%. When implementing the modified recipe, the failure rate of particle can be improved from 20% to less than 5%. The down-time of machine will reduce from 8.2% to 3.3%, therefore the available time of machine will increase from 65% to 85%. Finally Higher Cp Yield also will be obtained.

Although specific embodiments have been illustrated and described, it will be obvious to those skilled in the art that various modifications may be made without departing from what is intended to be limited solely by the appended claims.

What is claimed is:

1. A multi-step chemical-mechanical polishing method for improving tungsten chemical-mechanical polishing (CMP) process, wherein said method comprising:

placing a wafer on a first pad of a CMP system, wherein a head fixes said wafer on said first pad;

rotating said head to polish said wafer on said first pad by using a tungsten slurry;

transferring said wafer to place on a second pad of said CMP system, wherein said head fixes said wafer on said second pad;

rotating said head to polish said wafer on said second pad by using said tungsten slurry;

cleaning said wafer on said second pad by using a de-ionic water;

transferring said wafer to place on a third pad of said CMP system, wherein said head fixes said wafer on said third pad;

cleaning said wafer on said third pad by using said de-ionic water; and rotating said head to polish said wafer on said third pad by using an oxide slurry, wherein a pH value of said tungsten slurry and a pH value of said oxide slurry are opposite.

2. The method according to claim 1, wherein a duration of polishing said wafer on said second pad is approximately equal to a duration of polishing said wafer in said third pad.

3. The method according to claim 1, wherein a duration of cleaning said wafer on said second pad is approximately equal to a duration of cleaning said wafer in said third pad.

4. The method according to claim 1, further comprises a step of polishing a remained tungsten film with said tungsten slurry by an end-point system on said first pad.

5. The method according to claim 1, further comprises a step of polishing a remained tungsten film with said tungsten slurry by an end-point system on said second pad.

6. The method according to claim 1, further comprises a step of polishing a remained oxide film with said oxide slurry by an end-point system on said third pad.

* * * * *